US005765493A

United States Patent [19]

Akahane et al.

[11] Patent Number: 5,765,493

[45] Date of Patent: Jun. 16, 1998

[54] SEWING MACHINE WITH DETACHABLE LOOP TAKER MODULE

[75] Inventors: Kohichi Akahane, Nagoya; Takashi Kondo, Obushi; Masaki Shimizu, Toyoake; Yoshikazu Kurono, Aichi-ken; Fumiaki Asano, Nagoya, all of Japan

[73] Assignee: Brother Kogyo Kabushiki Kaisha, Nagoya, Japan

[21] Appl. No.: 752,290

[22] Filed: Nov. 19, 1996

[30] Foreign Application Priority Data

Nov. 20, 1995 [JP] Japan ..... 7-328091

[51] Int. Cl.[6] ..... D05B 1/08; D05B 69/30

[52] U.S. Cl. ..... 112/167; 112/220; 112/260

[58] Field of Search ..... 112/163, 166, 112/168, 167, 155, 260, 220, 165

[56] References Cited

U.S. PATENT DOCUMENTS

| | | | |
|---|---|---|---|
| 2,085,699 | 6/1937 | Kessler . | |
| 3,006,298 | 10/1961 | Johnson . | |
| 3,628,479 | 12/1971 | Schafer | 112/167 |
| 3,742,880 | 7/1973 | Franz . | |
| 4,407,210 | 10/1983 | Jung et al. | 112/167 |
| 4,624,201 | 11/1986 | Maggi | 112/168 |
| 4,690,081 | 9/1987 | Castagna et al. | 112/220 X |
| 5,189,971 | 3/1993 | Frankel et al. | 112/220 |
| 5,458,075 | 10/1995 | Tice et al. . | |
| 5,474,001 | 12/1995 | Tajima et al. . | |
| 5,549,061 | 8/1996 | Oda et al. | 112/220 |

FOREIGN PATENT DOCUMENTS

| | | |
|---|---|---|
| Y2-61-15816 | 5/1986 | Japan . |
| A-3-234291 | 10/1991 | Japan . |
| A-4-51991 | 2/1992 | Japan . |
| U-6-81481 | 11/1994 | Japan . |

*Primary Examiner*—Paul C. Lewis
*Attorney, Agent, or Firm*—Oliff & Berridge, PLC

[57] ABSTRACT

A sewing machine including a needle bar for mounting two needles separated by a distance in a principal shaft direction; a principal drive shaft for driving the needle bar and extending in the principal shaft direction; a bed portion; a first loop taker disposed in the bed portion; a transmission system for connecting movement between the first loop taker and the principal drive shaft; a loop taker module detachably provided to the bed portion; a second loop taker provided to the loop taker module; and servomotor provided in the loop taker module and for driving the second loop taker.

15 Claims, 13 Drawing Sheets

SEWING MACHINE WITH DETACHABLE LOOP TAKER MODULE

BACKGROUND OF THE INVENTION

1. Field of the Invention

The present invention relates to a sewing machine with a pair of sewing needles attached to a needle support body at the lower tip of a needle bar and more particularly to a pair of loop takers at positions corresponding to those of the needles.

2. Description of the Related Art

There has been known a two-needle sewing machine having a pair of needles and a pair of loop takers for simultaneously sewing both edges of belt loops in trousers. For example, Japanese Utility Model Publication No. HEI-6-81481 describes a rotation hook type two-needle sewing machine and an oscillating shuttle type two-needle sewing machine. The sewing machines have first and second needles attached to a needle support body at the lower tip of a needle bar. The needles are separated by a predetermined distance in a direction in which a principal shaft of the sewing machine extends. The needle closest to a column portion of the sewing machine is referred to as the first needle.

The sewing machine also has a pair of first and second loop takers at positions corresponding to the two needles. A drive force transmission system is provided for transmitting drive force from the sewing machine principal shaft to a shuttle shaft for driving the shuttles. A first drive system is provided for connecting movement of the shuttle shaft to the first shuttle and a separate second drive system is provided for connecting movement of the shuttle shaft to the second shuttle.

Because the distance between the two needles needs to be adjustable to suit requirements of the workpiece cloth, there is a need that the distance between the two shuttles also be adjustable. To enable positional adjustment in the axial direction of the first shuttle and its drive system, a gear at the input side of the first drive system is formed elongated in its axial direction. Also, to enable positional adjustment in the axial direction of the second shuttle and its drive system a gear at the input side of the second drive system is formed elongated in its axial direction. The second shuttle and its drive system are mounted on a shuttle unit stand, which serves as a frame for supporting the second shuttle and its drive system and for enabling their positional adjustment in the axial direction in the bed portion.

Japanese Unexamined Utility Model Publication No. SHO-61-15816 describes a similar sewing machine provided with a needle drive motor and a shuttle drive motor controlled to operate in synchronization to prevent skipping stitches and to enhance the tightness of stitches. Japanese Unexamined Patent Publication No. HEI-3-234291 describes a sewing machine including a sewing machine motor for driving the sewing machine needle via the principal shaft and a shuttle drive motor for driving the shuttle independently from the sewing machine motor. Further, a rotary encoder for detecting the rotational amount of the sewing machine principal shaft is also provided. A movement control means is provided for rotating the shuttle drive motor by an amount corresponding to an amount that the principal shaft is rotated by hand. This configuration enhances synchronization between the operations of the sewing needle and the shuttle. U.S. Pat. No. 5,458,075 describes a two-needle sewing machine with two shuttles and two separate servo motors for driving the shuttles.

Because this configuration allows the shuttles to be driven independently, there is no need to provide a system for transmitting drive force from the principal shaft to the shuttles.

SUMMARY OF THE INVENTION

However, because the sewing machine disclosed in Japanese Unexamined Utility Model Publication No. HEI-6-81481 has two drive systems for driving the two thread shuttles using drive force of the sewing machine principal shaft, an elongated drive shaft and also gears at both ends of the drive shaft are necessary for transmitting drive force from the shuttle shaft to the second shuttle. Also, the gear at the input side of the second drive system must be elongated in its axial direction to enable adjustments in positions of the second drive system and the second shuttle in the axial direction. Therefore, the configuration of the second drive system becomes complicated and requires a great number of components so that the overall system is large and expensive to produce. Further, a bed portion for incorporating the gears and the drive shaft of the second drive system within the bed portion must also be large.

Furthermore, because each type of two-needle sewing machine has a bed portion with different length and configuration, a second drive system for driving the second shuttle also must be produced separately for each sewing machine type. This makes the second drive system difficult to produce in a configuration usable with a variety of different sewing machines. Also, the second drive system and the second shuttle are difficult to repair during break downs.

The sewing machine described in U.S. Pat. No. 5,458,075 is provided with two servomotors for driving two shuttles separately in the two-needle sewing machine. Although the drive system for driving the two shuttles has a simpler configuration, the cost of producing the sewing machine is high because two servomotors are necessary.

It is an objective of the present invention to overcome the above-described problems and to provide a sewing machine having a pair of sewing needles and a pair of thread shuttles, but with a drive system having a simple configuration for driving one of the shuttles, wherein the sewing machine is inexpensive to produce, has high usability, has a compact bed portion, and is easy to repair.

In order to achieve the above-described objectives, a sewing machine according to the present invention includes a needle bar for mounting two needles separated by a distance in a principal shaft direction that is parallel to a central axis of a principal drive shaft; the principal drive shaft for driving the needle bar and extending in the principal shaft direction; a bed portion; a first loop taker disposes in the bed portion; movement connection means for mechanically connecting movement between the first loop taker and the principal drive shaft; a loop taker module provided detachably or not detachably to the bed portion; a second loop taker provided in the loop taker module; and drive means provided in the loop taker module and for driving the second loop taker independently from the principal drive shaft. A sewing machine according to another aspect of the invention includes a needle bar for mounting two needles; a principal drive shaft for driving the needle bar and extending in a principal shaft direction; a bed portion first and second loop takers disposed in the bed portion each at a position corresponding to one of the needles; movement connection means for connecting movement between the first loop taker and the principal drive shaft; and a loop taker module fixed to the bed portion and including the second loop taker and a drive means for driving the second loop taker independently from the principal shaft, the module being switchable between a usage position and a retracted position.

DETAILED DESCRIPTION OF THE PREFERRED EMBODIMENT

Figure 1:
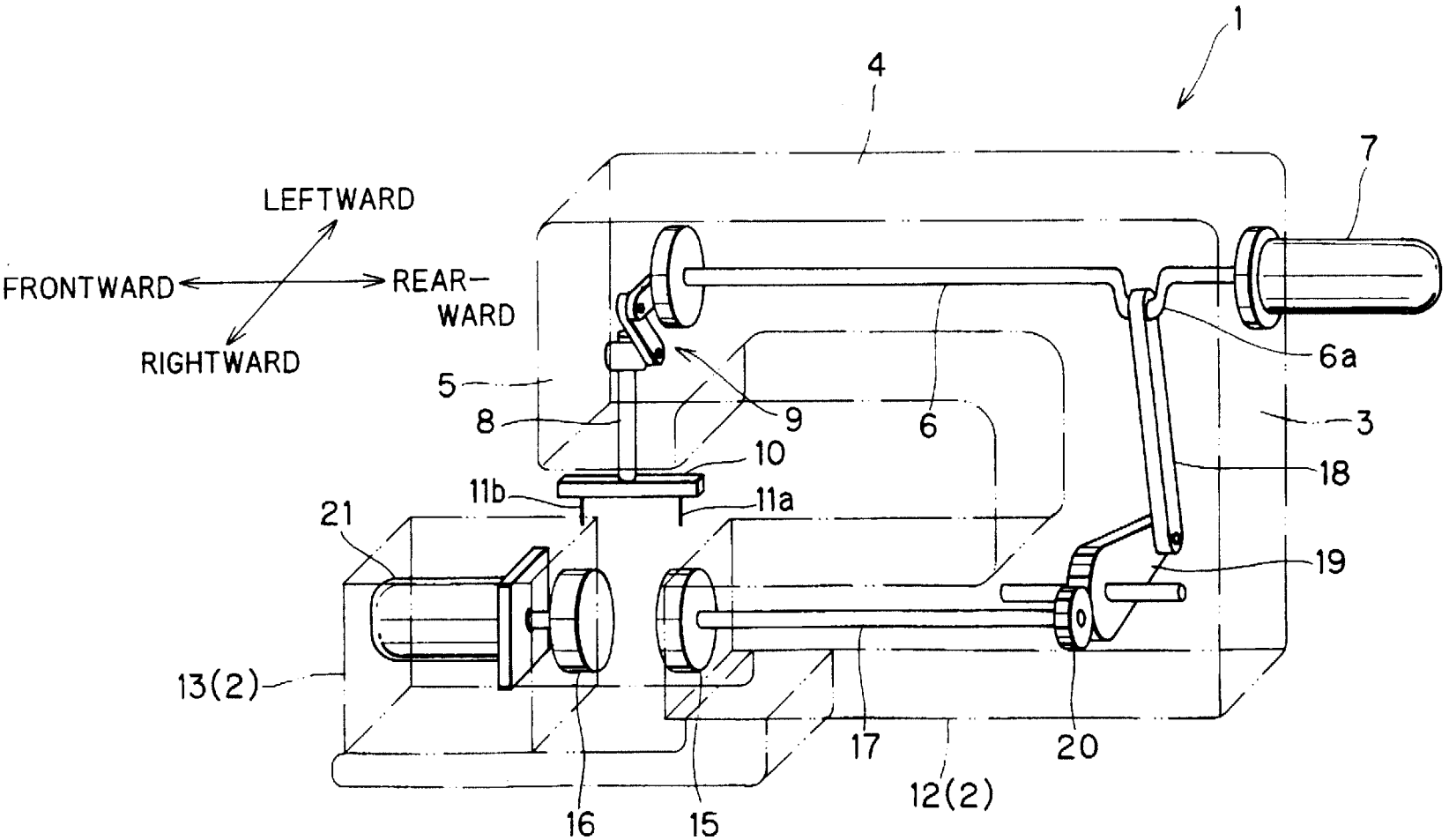
FIG. 1 is a perspective view partially in phantom schematically showing a two-needle sewing machine according to an embodiment of the present invention.

A sewing machine according to a preferred embodiment of the present invention will be described while referring to the accompanying drawings wherein like parts and components are designated by the same reference numerals to avoid duplicating description.

FIG. 1 is a perspective view partially in phantom showing a two-needle sewing machine 1 according to the present embodiment. The two-needle sewing machine is for simultaneously stitching in a close stitch both ends of trouser belt loops. The sewing machine 1 includes a bed portion 2; a column portion 3 extending upward from one end of the bed portion 2; an arm portion 4 extending horizontally, that is, in parallel with the bed portion 2, from the upper end of the column portion 3; and a head portion 5 at the end of the arm portion 4 opposite the end thereof connected to the column portion. A principal shaft 6 is disposed within the arm portion 4. The principal shaft is oriented in a principal shaft direction. A sewing motor 7, such as an induction motor, for driving the principal shaft 6 is provided protruding outward from the upper portion of the column portion 3. A needle bar crank mechanism 9 connected to the principal shaft 6 and to a vertically disposed needle bar 8 is disposed in the head portion 5. With this configuration, when the sewing machine motor 7 drives the principal shaft 6, the needle bar 8 is driven up and down via the needle bar crank mechanism 9. A needle support body 10 having a horizontal posture is attached to the lower tip of the needle bar 8. A pair of sewing needles 11*a*, 11*b* are connected to either tip of the needle support body 10 and are spaced apart from each other in the principal shaft direction. The sewing needle 11*b* is attached so that its position can be adjusted in frontward and rearward directions indicated by arrows in FIG. 1, parallel to the principal shaft direction.

The bed portion 2 includes a bed portion body 12 and a shuttle module 13 disposed separated from the bed portion body 12 by a predetermined gap. An oscillating shuttle 15 is provided in the bed portion body 12. An oscillating shuttle 16 is provided in the shuttle module 13 at a position confronting the oscillating shuttle 15. The oscillatory shuttles 15, 16 are for catching thread loops. A thread bobbin is provided internally to each of the oscillating shuttles 15, 16. A shuttle shaft 17 for driving the oscillating shuttle 15 by drive power of the principal shaft 6 is disposed with a horizontal posture internally to the bed portion body 12. A crank rod 18 is connected to a crank portion 6*a* of the principal shaft 6. A sector gear 19 is connected to the crank rod 18. A gear 20 attached to the right tip of the shuttle shaft 17 as viewed in FIG. 1 is meshingly engaged with the sector gear 19 and reciprocally rotatably driven by the principal shaft 6 via the crank rod 18 and the sector gear 19. With this configuration, the oscillating shuttle 15 is driven in synchronization with vertical movement of the needle bar 8 in the same manner as in conventional sewing machines.

The shuttle module 13 includes the oscillating shuttle 16 and a servomotor 21 for driving the oscillating shuttle 16 independently from the principal shaft 6. The shuttle module 13 includes a mechanism enabling shifting of its position between a usage position, in which it is used, and a retracted or inoperative position rotated horizontally from the usage position by a predetermined pivoting angle. It should be noted that the oscillating shuttle 16 is further from the oscillating shuttle 15 and the head portion 5 in the retracted position than in the usage position. The oscillating shuttle 16 is also configured so that its position can be manually adjusted forward and rearward in order to adjust the gap between the shuttles 15, 16 according to the changes in the distance between the sewing needles 11*a*, 11*b* and in order to adjust the positional relationship between the sewing needle 11*b* and the loop seizing beak of the oscillating shuttle 16. Detailed description of the configuration of the shuttle module 13 and oscillating shuttle 16 will be provided later.

Figure 2:
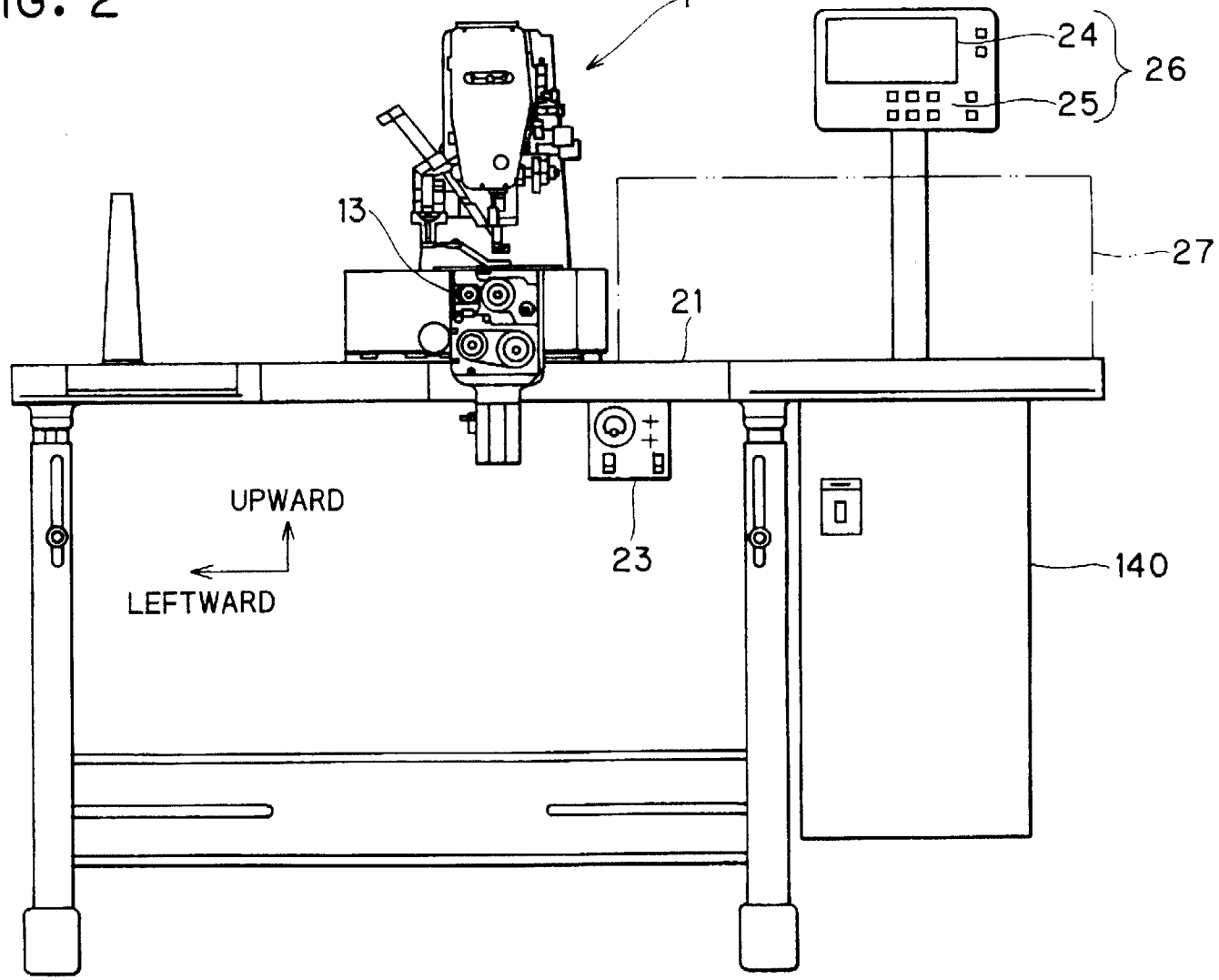
FIG. 2 is a front view showing a sewing system including the two-needle sewing machine of FIG. 1.
Figure 3:
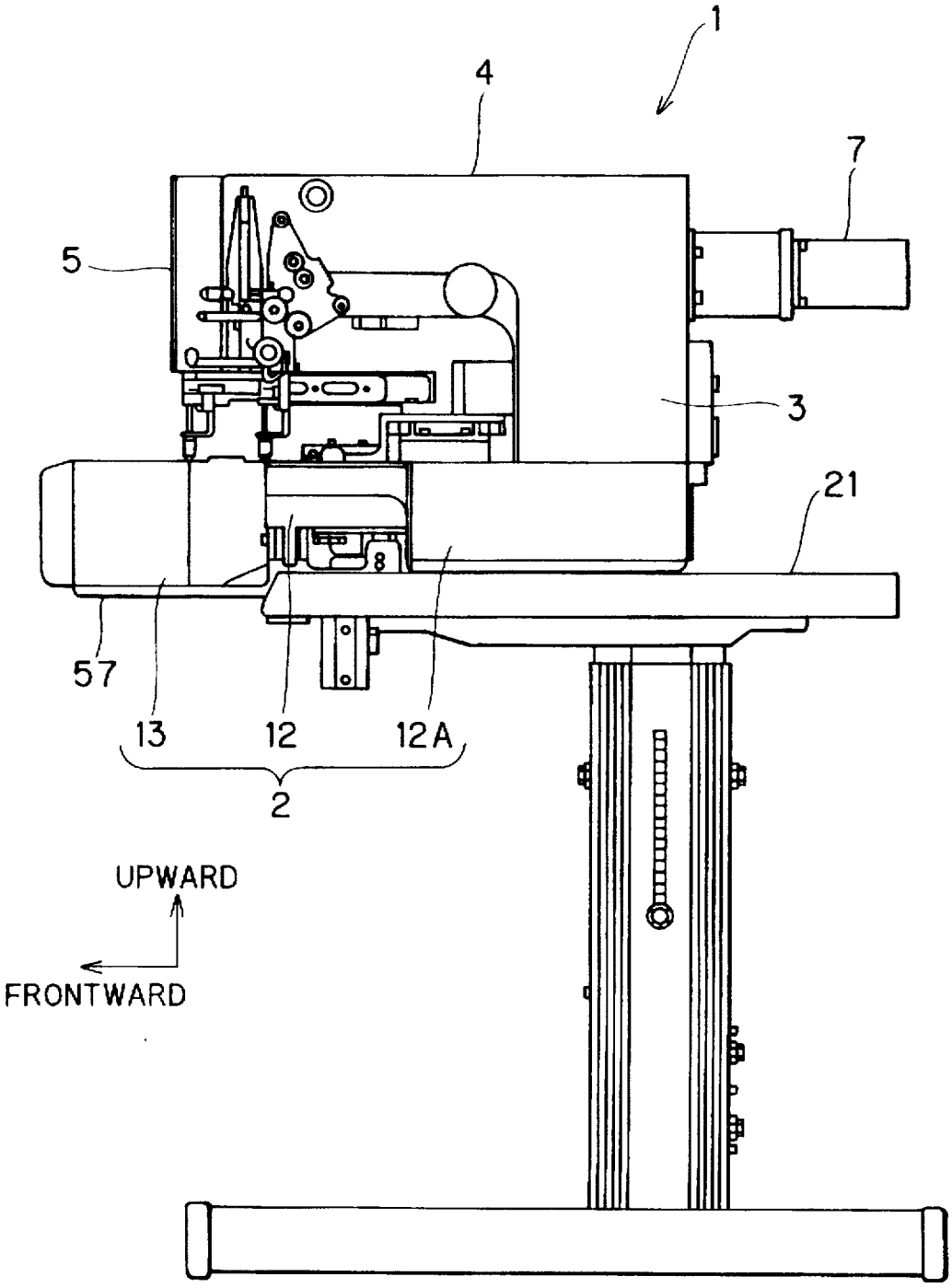
FIG. 3 is a view from a right side of the sewing system.

First, a brief explanation of the overall configuration of the two-needle sewing machine 1 will be provided while referring to FIGS. 2 and on. FIG. 2 is a front view of the two-needle sewing machine 1 mounted on a work table 21. FIG. 3 is a view from the right side of FIG. 2.

As shown in FIGS. 2 and 3, the two-needle sewing machine 1 is mounted in the center portion of the work table 21. A control unit 140 and a manual operation unit 23 are attached to the undersurface of the work table 21. An operation panel 26 having a liquid crystal display 24 and an operation portion 25 is disposed with an upright posture to the right edge of the work table 21. A supply unit 27 for supplying a continuous material for forming belt loops is provided adjacent to the operation panel 26 on top of the work table 21. Further explanation of the supply unit 27 will be omitted.

Next, a brief explanation for a cloth feed mechanism 30 will be provided while referring FIGS. 4 through 9.

Figure 4:
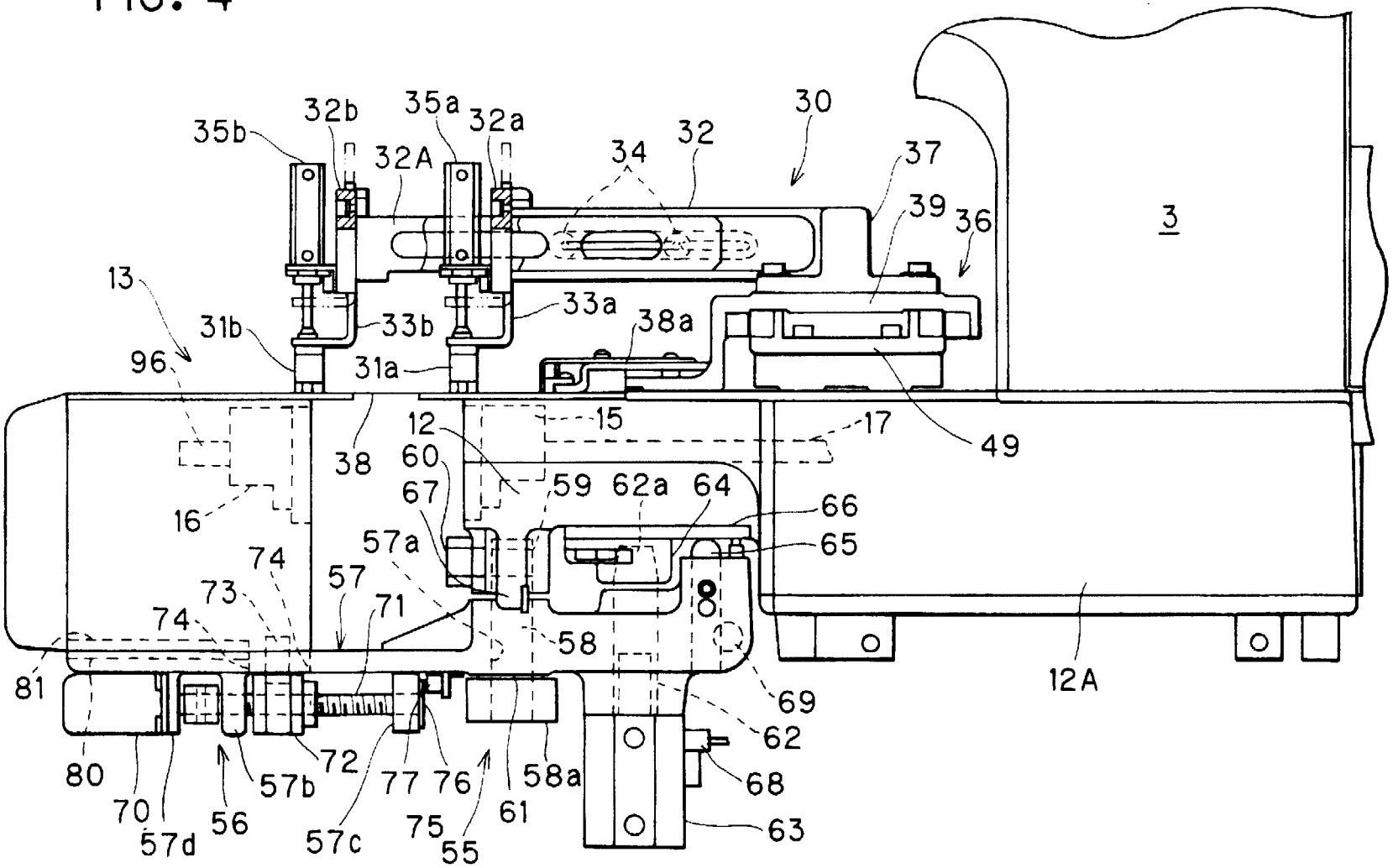
FIG. 4 is an enlarged view partially in phantom showing a cloth feed mechanism and a bed portion of the two-needle sewing machine, the bed portion including a shuttle module.
Figure 5:
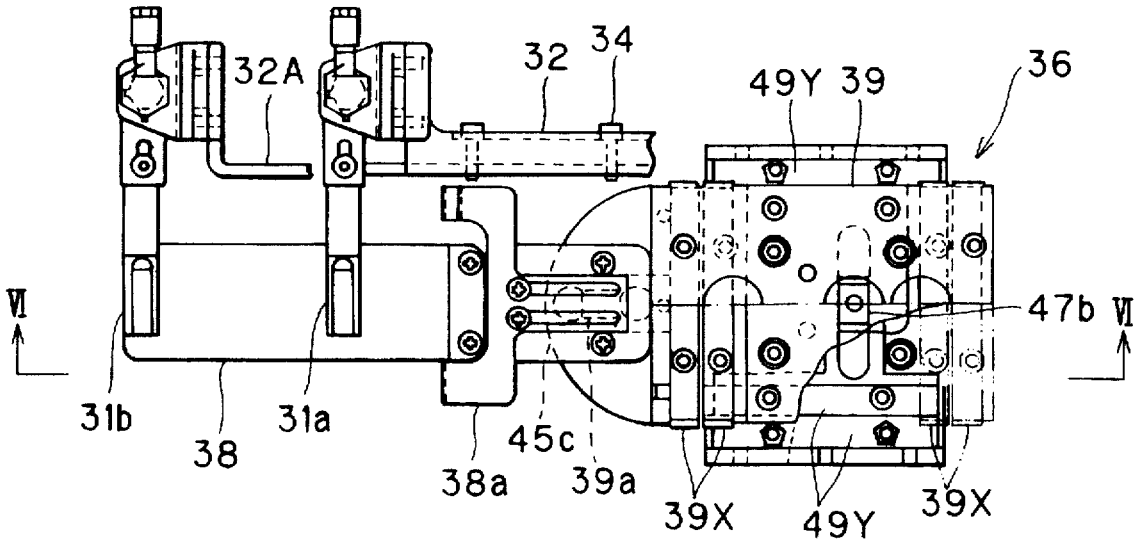
FIG. 5 is a plan view showing the bed portion and the cloth feed mechanism.
Figure 6:
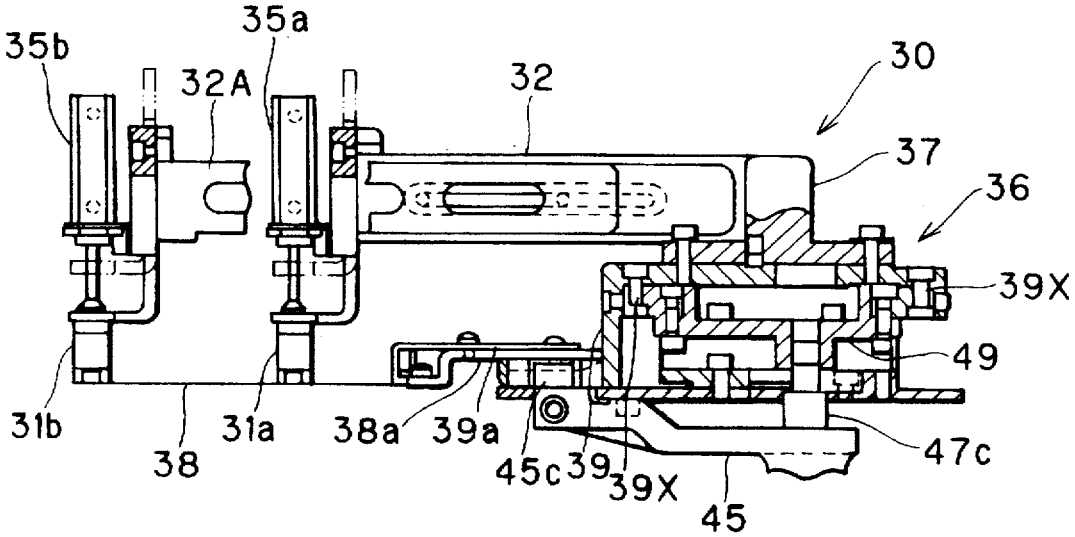
FIG. 6 is a side view partially in cross-section taken along line VI—VI of FIG. 5.

As shown in FIGS. 4 through 6, cloth pressure feet 31*a*, 31*b* are disposed at positions corresponding to those of the sewing needles 11*a*, 11*b*. The cloth pressure foot 31*a* is supported by an L-shaped plate 33*a* attached to a vertical guide portion 32*a* at the front tip of a support arm 32. The cloth pressure foot 31*b* is supported on an L-shaped plate 33*b* attached to a vertical guide portion 32*b* at the front tip of a movable support arm 32A, which is engaged with the support arm 32 so as to be freely slidable frontward and rearward. The movable support arm 32A is releasingly fixed to the support arm 32 by two screws 34, each having a knob. The L-shaped plate 33*a* fixed to the cloth pressure foot 31*a* is driven vertically by an air cylinder 35*a*, which is mounted to the vertical guide 32*a* so as to be freely slidable in the vertical direction. The L-shaped plate 32*b* fixed to the cloth pressure foot 31*b* is driven vertically by an air cylinder 35*b*, which is mounted to the vertical guide portion 32*b* so as to be freely slidable in the vertical direction. The support arm 32 is fixed to a connection member 37 of an XY feed mechanism 36. The connection member 37 is fixed to a feed operation body 39. The air cylinders 35*a*, 35*b* are driven and controlled by the control unit 140.

A cloth reception plate 38 extends beneath the cloth pressure feet 31*a*, 31*b* in order to sandwich a workpiece cloth between itself and cloth pressure feet 31*a*, 31*b*. The cloth reception plate 38 is driven by the XY feed mechanism 36 to feed the cloth independently in the X direction, that is, rightward and leftward, and in the Y direction, that is, rearward and forward. The cloth reception plate 38 is fixed to the feed operation body 39 via a support plate 38*a*. With this configuration, the cloth reception plate 38 operates integrally with the cloth pressure feet 31*a*, 31*b* to feed the workpiece cloth while it is sandwiched between the cloth reception plate 38 and the cloth pressure feet 31*a*, 31*b*.

The XY feed mechanism 36 including the front/rear feed operation member 39 and a left/right feed operation member 49 will next be described while referring to FIGS. 5 through 9. A q axis servomotor 41 for supplying drive force to drive the front/rear feed operation member 39 and an R axis servomotor 43 for supplying drive force to drive the left/right feed operation member 49 are disposed within a case 40 of a bed portion base 12A of the bed portion 12. The q axis servomotor 41 drives a spiral cam shaft 42 and the R axis servomotor 43 drives a spiral cam shaft 44. A small ring 45*b* at one tip of an L-shaped swing arm 45 is meshingly engaged with the spiral cam shaft 42. A base portion 45*a* at the pivotable center of the swing arm 45 is pivotably rotatably fitted to the upper tip of a support shaft 46. A bridge 45*c* at the other tip of the swing arm 45 is meshingly engaged with a narrow engagement hole 39*a* extending frontward and rearward in the feed operation body 39. The base tip of a swing arm 47 is pivotably rotatably fitted on a support shaft 48. A small ring 47*a* positioned at the center of the swing arm 47 is meshingly engaged with the spiral cam shaft 44. A bridge 47*b* at the leftward most tip of the swing arm 47 is meshingly engaged with a cylindrical engagement hole 49*a* extending leftward and rightward through the feed operation body 49. A shaft portion 47*c* below the bridge 47*b* is connected to the base portion 45*a*.

The front/rear feed operation member 49 is supported so as to be freely slidable in the frontward and rearward directions by a slide unit 49Y with respect to the base member 50. The left/right feed operation member 39 is supported so as to be freely slidable in the leftward and rightward directions by a slide unit 39X with respect to the front/rear feed operation member 49.

With this configuration, the front/rear feed operation member 49 can be fed frontward and rearward by drive of the R axis servomotor 43 as transmitted via the spiral cam shaft 44, the swing arm 47, and the slide unit 49Y. The front/rear feed operation member 39 can be fed leftward and rightward by drive of the q axis servomotor 41 as transmitted via the spiral cam shaft 42, the swing arm 47, and the slide unit 39X. However, strictly speaking, feed in the X direction and feed in the Y direction are performed via both motors 41, 43. With this configuration, feed amount in the X direction and the Y direction can be precisely controlled by controlling rotational amount and direction of the motors 41, 43 using the control unit 140. It should be noted that the above-described cloth feed mechanism 30 is similar to existing mechanisms.

Next, the shuttle module 13 will be explained.

First, an explanation will be provided for a position switching mechanism 55 for switching the position of the shuttle module 13 and a minute movement mechanism 56 for moving the shuttle module 13 slightly frontward and rearward.

Figure 7:
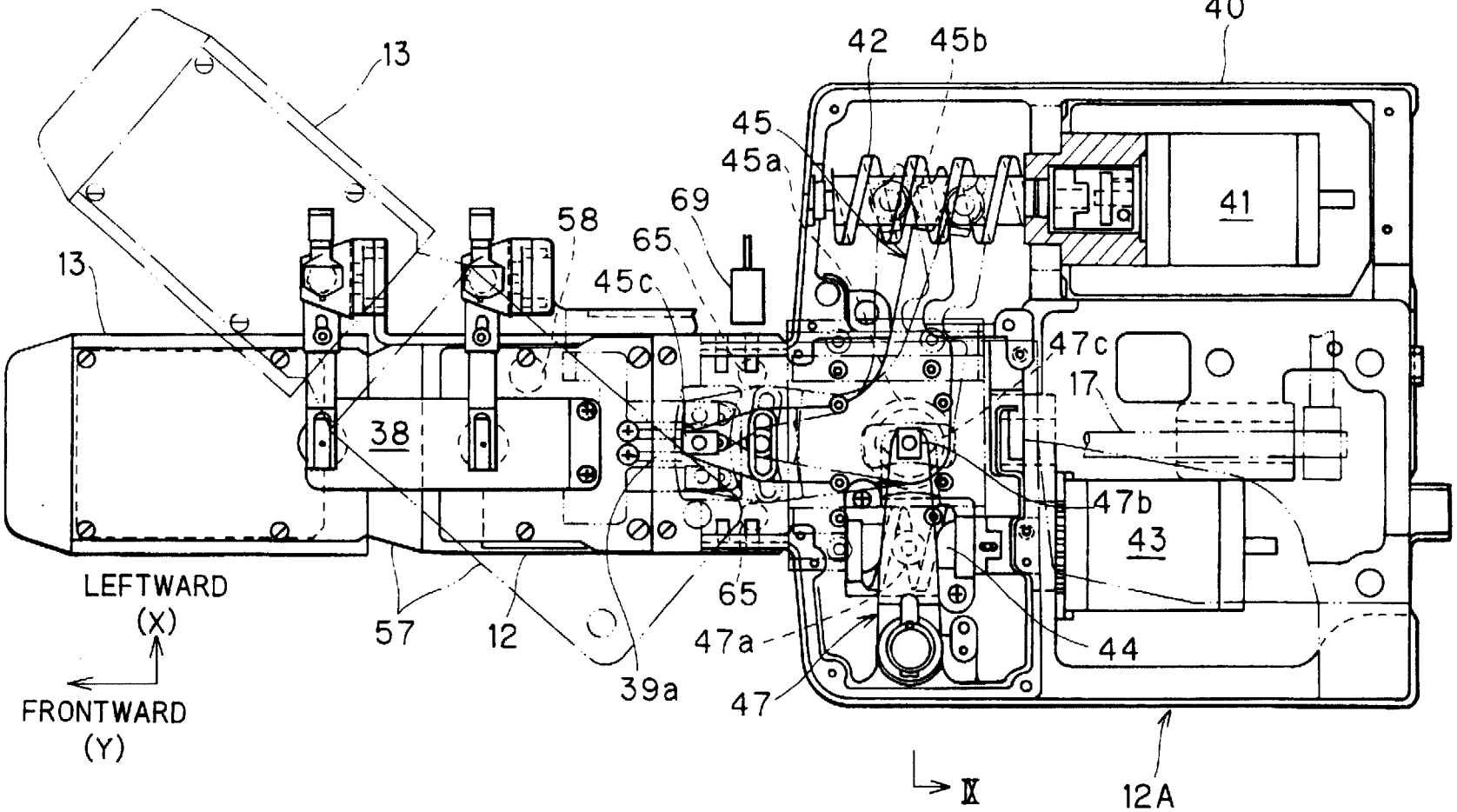
FIG. 7 is a plan view showing the drive system of the cloth feed mechanism and positional change possible by the bed portion.
Figure 8:
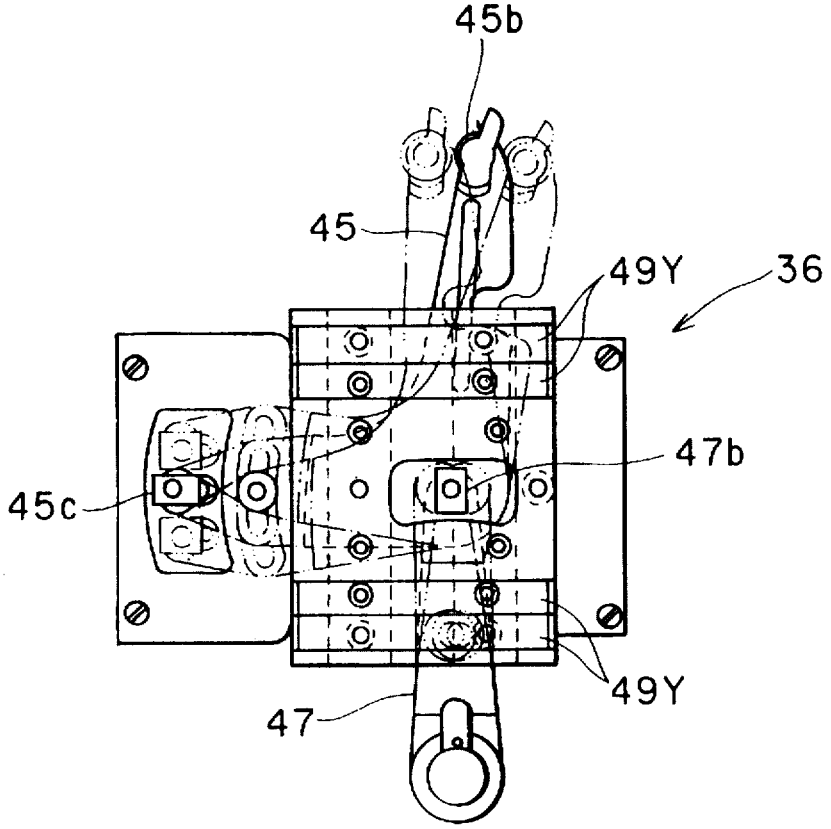
FIG. 8 is a plan view showing a swing arm and other components of the cloth feed mechanism.
Figure 9:
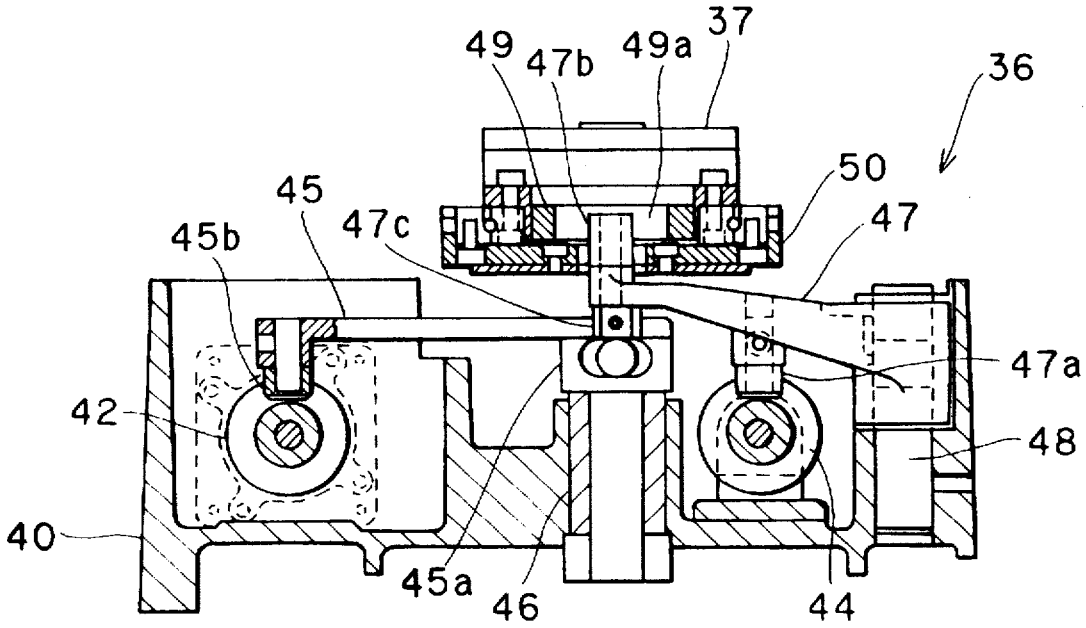
FIG. 9 is a cross-sectional view taken along line IX—IX of FIG. 7.
Figure 10:
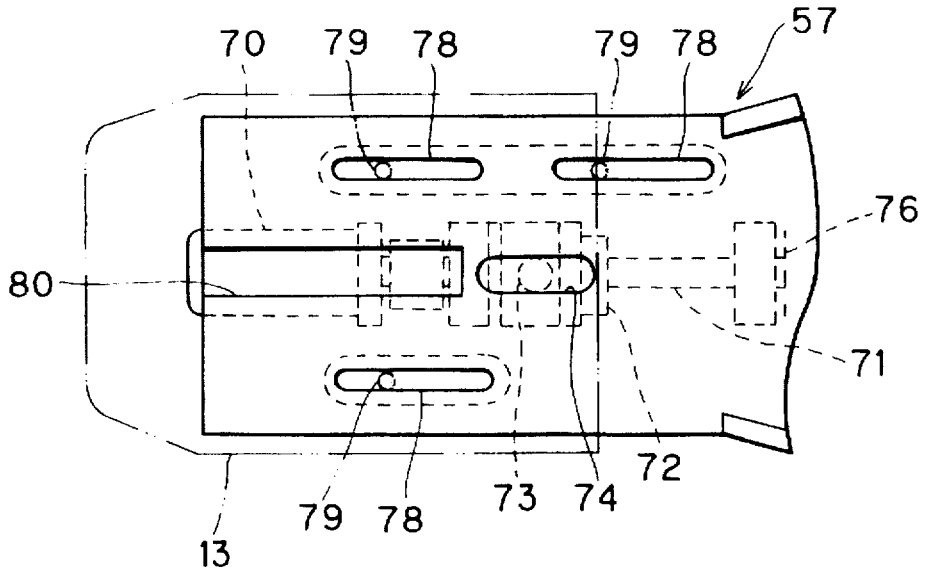
FIG. 10 is a plan view showing a pivot frame for enabling positional change of the bed portion shown in FIG. 7.

As shown in FIGS. 4, 7, and 10, the shuttle module 13 is formed in a substantially parallelepiped block shape. A pivot frame 57 extends horizontally from the lower side of the bed portion 12 and is attached at its upper front surface to the shuttle module 13. An upright pivot shaft 58 having a head portion 58*a* for supporting the pivot frame 57 passes through a support hole 57*a* opened in the pivot frame 57 and into a hole 59 formed near the front left edge of the bed body 12. The support shaft 58 is formed with a hole in which is fitted a taper screw portion at the tip of a horizontal bolt 60 disposed between the head portion 58*a* of the support shaft 58 and the pivot frame 57. A low friction bearing 61 is provided for enabling the pivot frame 57 to pivot horizontally around the support shaft 58. The pivot frame 57 can be pivoted between a usage position shown by a solid line in FIG. 7 and a retracted or inoperative position pivoted horizontally approximately 45 degrees from the usage position as shown by a chain line in FIG. 7.

A lock pin 62 for locking the shuttle module 13 in the usage position is driven vertically by an air cylinder 63 so that a tapered engagement portion 62*a* at the upper tip of the lock pin 62 engages in the engagement hole of a boss portion 64 of the bed body 12. A pair of left and right pressing members 65 abutting the lower surface of a bearing plate 66 are provided to the rear tip of the pivot frame 57. When the shuttle module 13 is to be switched from the usage position to the inoperative position, the lock pin 62 is lowered by the air cylinder 63 and the shuttle module 13 is manually pivoted horizontally into the inoperative position. The pressing members 65 follow the lower surface of the bearing plate 66 until the shuttle module 13 is switched into the inoperative position. It should be noted that a stopper 67 is provided for stopping the shuttle module 13 in the usage position. Although, the shuttle module 13 is configured to be manually moved into the inoperative position in the present embodiment, a spring member or an air cylinder can be provided to automatically switch the shuttle module 13 into the inoperative position.

A proximity switch 68 for detecting the position of the lock pin 62 turns off when the lock pin 62 is pulled out of the engagement hole of the boss portion 64. A proximity switch 69 for detecting the position of the shuttle module 13 turns on when the shuttle module 13 is switched to the usage position. Detection signals from the switches 68, 69 are supplied to the control unit 140. Switching the shuttle module 13 to the inoperative position exposes the forward portion of the oscillating shuttle 15 and the rear portion of the oscillating shuttle 16. Therefore, operations such as exchanging the bobbins within the oscillating shuttles 15, 16 and removing tangled needle and bobbin threads can be easily and efficiently executed.

Next, an explanation will be provided for the minute movement mechanism 56 for moving the shuttle module 13 slightly frontward and rearward in order to adjust the distance between the oscillating shuttles 15, 16 in coordination with adjustment in distance between the sewing needles 11*a*, 11*b* and for adjusting minute positional changes between the loop seizing beak of the oscillating shuttle 16 and the sewing needle 11*b*.

As shown in FIG. 4, to the lower surface of the pivot frame 57 is provided: a shuttle interval adjustment pulse motor 70; a ball screw shaft 71 driven frontward and rearward by the pulse motor 70; and a ball screw nut 72 in screwing engagement with the ball screw shaft 71. The pulse motor 70 is fixed to a bracket 57*d* of the pivot frame 57. The ball screw shaft 71 is rotatably supported on a pair of the brackets 57*b*, 57*c* of the pivot frame 57. A slot 74 elongated frontward and rearward is formed in the pivot frame 57. A pin member 73 fixed to the lower tip of the shuttle module 13 passes through the slot 74 and engages in an engagement hole of the ball screw nut 72 so that rotating movement of the ball screw nut 72 is restricted. The pin member 73 also connects the ball screw nut 72 with the shuttle module 13 so that these move frontward and rearward together.

With this configuration, the shuttle module 13 can be moved slightly forward or rearward via the pin member 73 by loosening two screw members 79, which are for fixing the shuttle module 13 to the pivot frame 57 in a manner to be described later with reference to FIG. 10, and by driving the ball screw shaft 71 by the pulse motor 70 so that the ball screw nut 72 moves slightly rearward or forward. A disc plate 76 of an origin detection unit 75 is fixed to the front tip of the ball screw shaft 71. An optical or electromagnetic origin sensor 77 for detecting small slits formed in the disc plate 76 is attached to the pivot frame 57. The detection signal from the origin sensor 77 is supplied to the control unit 140 so that the control unit 140 can control the pulse motor 70.

FIG. 10 is a plan view showing essential portions of the pivot frame 57 with the shuttle module 13 removed. Elongated slits 78 extending frontward and rearward are formed through the pivot frame 57. The screw members 79 extend downward through the elongated slit 78 and are screwingly engaged with the lower tip of the shuttle module 13. As mentioned above, the shuttle module 13 is fixed to the pivot frame 57 by the screw members 79, and by loosening the screw members 79, the shuttle module 13 can be moved slightly frontward and rearward. The shuttle module 13 can be removed from the pivot frame 57 by removing the screw members 79 entirely.

Figure 14:
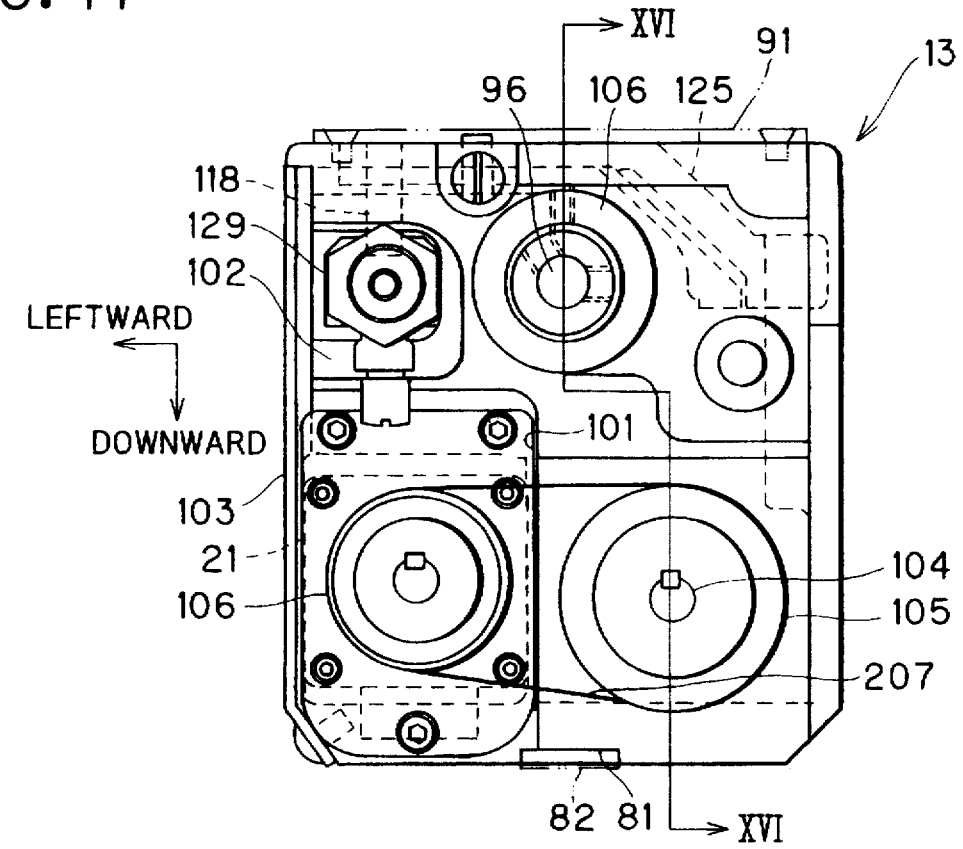
FIG. 14 is a front view partially in phantom showing the shuttle module.

Further, as shown in FIG. 14, a shallow key groove 80 is formed extending frontward and rearward in the upper surface of the pivot frame 57 and a shallow key groove 81 opposing the key groove 80 is formed extending frontward and rearward in the lower tip surface of the shuttle module 13. A common key member 82 is mounted in these key grooves 81, 82 in order to prevent the shuttle module 13 from shifting leftward and rightward with respect to the pivot frame 57.

Next, a brief explanation will be provided for mechanisms within the shuttle module 13.

As shown in FIGS. 11 through 17, the shuttle module 13 includes a housing 90; a needle plate 91 attached by screws to the upper surface of the housing 90; the oscillating shuttle 16; a servomotor 21 for driving the oscillating shuttle 16 via a drive transmission system; a thread cutting mechanism 93 for cutting the needle thread and the bobbin thread; a lubrication supply mechanism 130; and an origin sensor 95 for detecting origin position of a drive shaft of a drive transmission system. The drive shaft 96 extends frontward and rearward through the shuttle module 13. The oscillating shuttle 16 is disposed in the vicinity of the upper tip of the shuttle module 13 and includes a driver 97 driven by the shuttle shaft 96; a middle shuttle 98 driven by the driver 97 and having a loop seizing beak 98*a* at its tip; a bobbin case 99 within the middle shuttle 98; and a large shuttle body 100.

Figure 15:
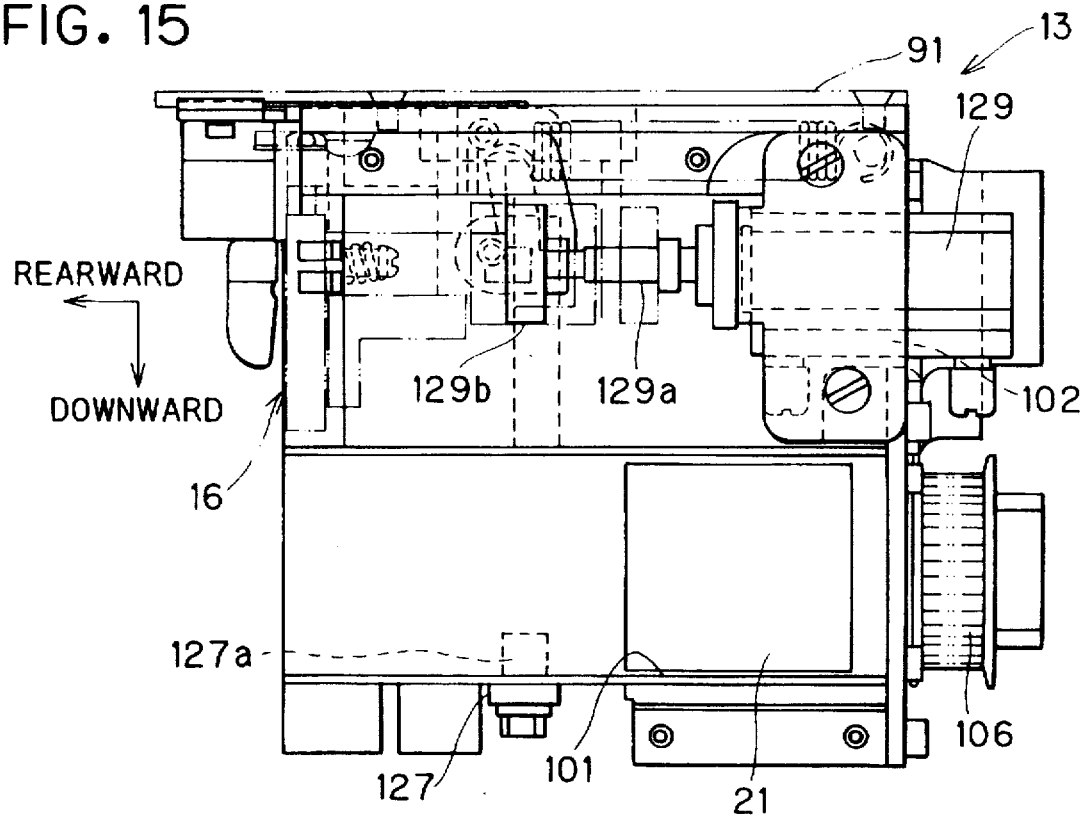
FIG. 15 is a left-side view partially in phantom showing the shuttle module.

As can be best seen in FIGS. 14 and 15, a motor housing indentation 101 is formed in the lower left side of the housing 90. A cylinder housing indentation 102 is formed in the upper left side of the housing 91 above the motor housing indentation 101. The servomotor 21 is disposed with a horizontal posture in the motor housing indentation 101. A cover plate 103 covers the left side surface of the motor housing indentation 101 and the cylinder housing indentation 102.

Figure 16:
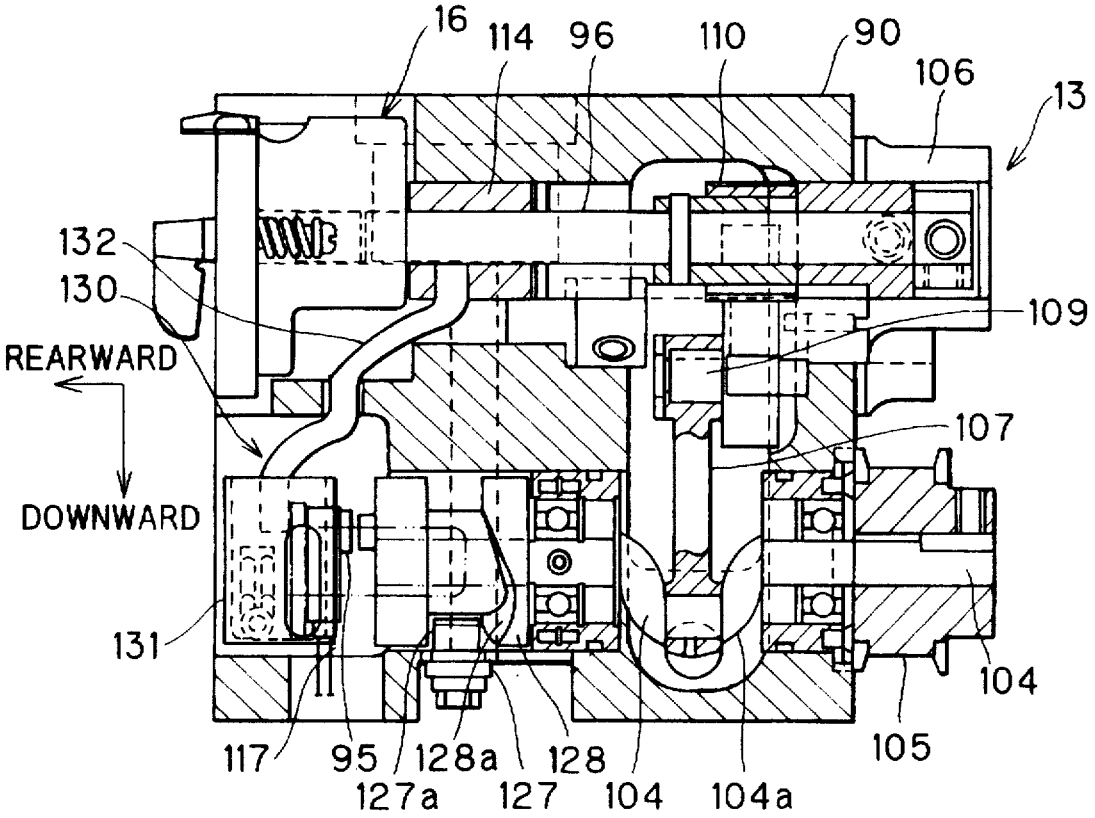
FIG. 16 is a cross-sectional view taken along line XVI—XVI of FIG. 14.
Figure 17:
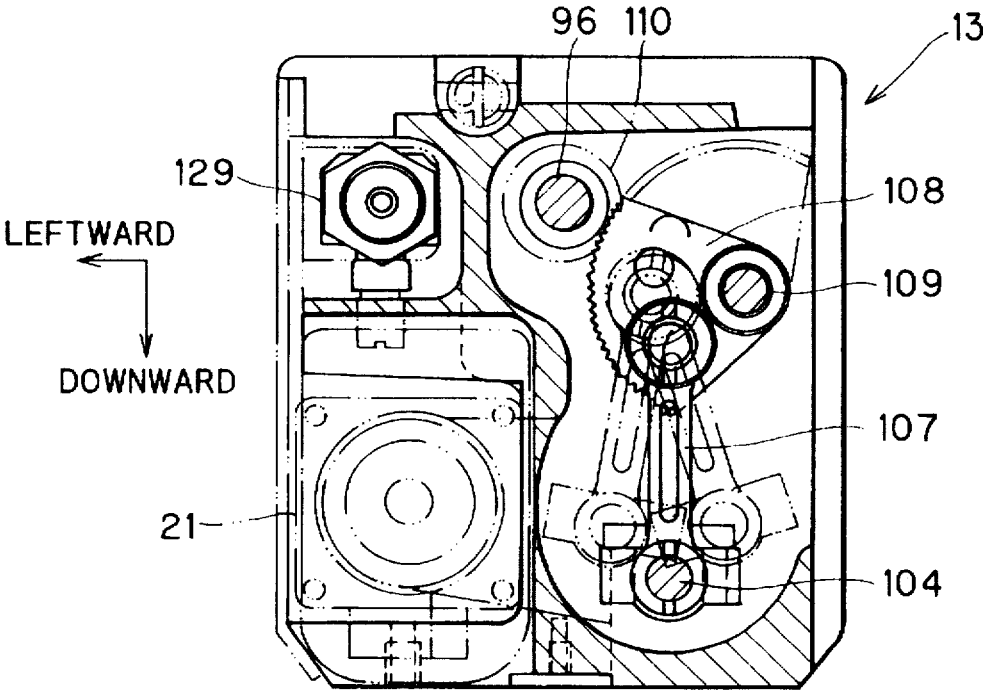
FIG. 17 is a cross-sectional view taken along line XVII—XVII of FIG. 11.

As best seen in FIG. 16, a drive shaft 104 extends through the lower portion of the shuttle module 13 from the front to the rear of the shuttle module 13. A pulley 105 attached to the front tip of the drive shaft 104 and a pulley 106 fixed to the output shaft of the servomotor 21 are connected to move in association by a timing belt 106. As best seen in FIGS. 16 and 17, a sector gear 108 is reciprocally swingably driven around a shaft 109 by a crank rod 107 connected to move in association with a crank portion 104*a* of a drive shaft 104. A gear member 110 disposed on the shuttle shaft 96 is meshingly engaged with the sector gear 108. With this configuration, rotation of the drive shaft 104 drives the sector gear 108 to reciprocally pivot. The gear member 110 integrally reciprocally rotates with pivoting movement of the sector gear 108 so that the driver 97 of the oscillating shuttle 16 is driven to reciprocally rotate.

Figure 12:
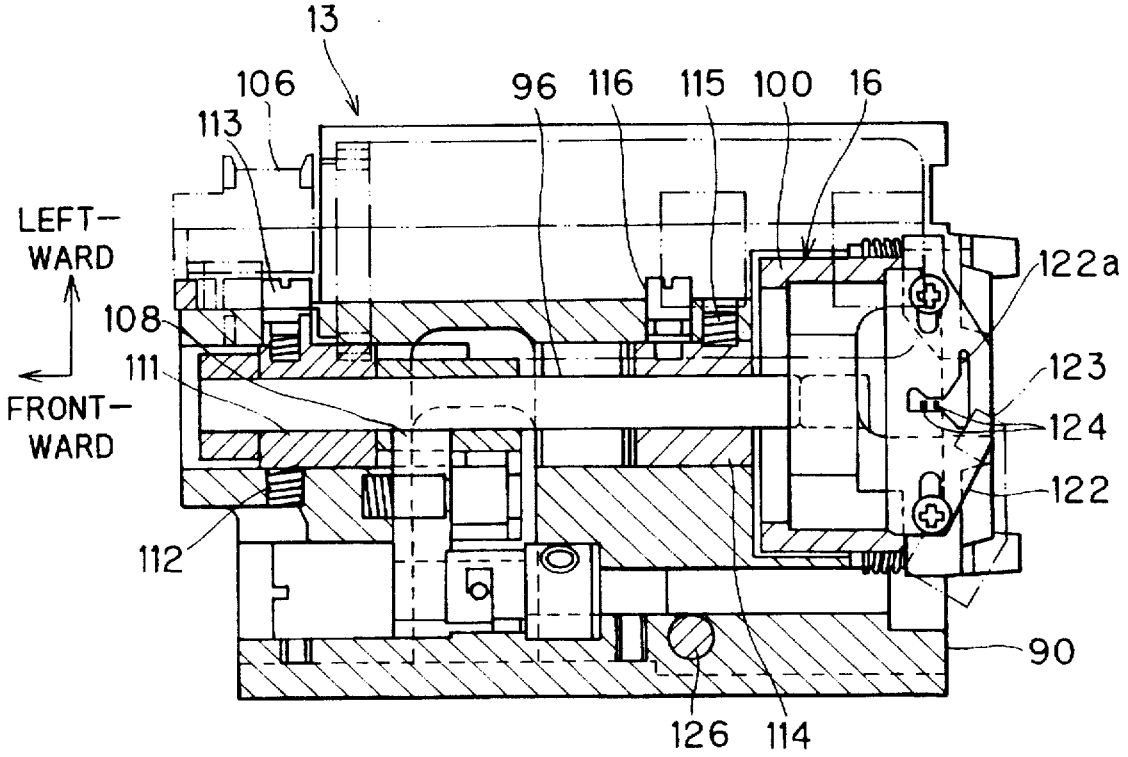
FIG. 12 is a cross-sectional view taken along line XII—XII of FIG. 13.

As shown in FIG. 12, the position of the shuttle shaft 96 in its axial direction is set by a collar 111, that is detachably mounted with the shuttle shaft 96 and that is fixed to the housing 90 by a screw 112. In addition, an eccentric screw 113 is provided to enable minute adjustment in the axial position of the shuttle shaft 96. By loosening the screw 112, the axial position of the shuttle shaft 96 can be adjusted by rotating the eccentric screw 113. A sleeve body 114 fitted around the shuttle shaft 96 is attached to the shuttle body 100 and fixed to the housing 90 by a screw 115. An eccentric screw 116 is provided to enable minute adjustment in the axial position of the large shuttle body 100. By loosening the screw 115, the axial position of the large shuttle body 100 can be adjusted by rotating the eccentric screw 116.

Figure 11:
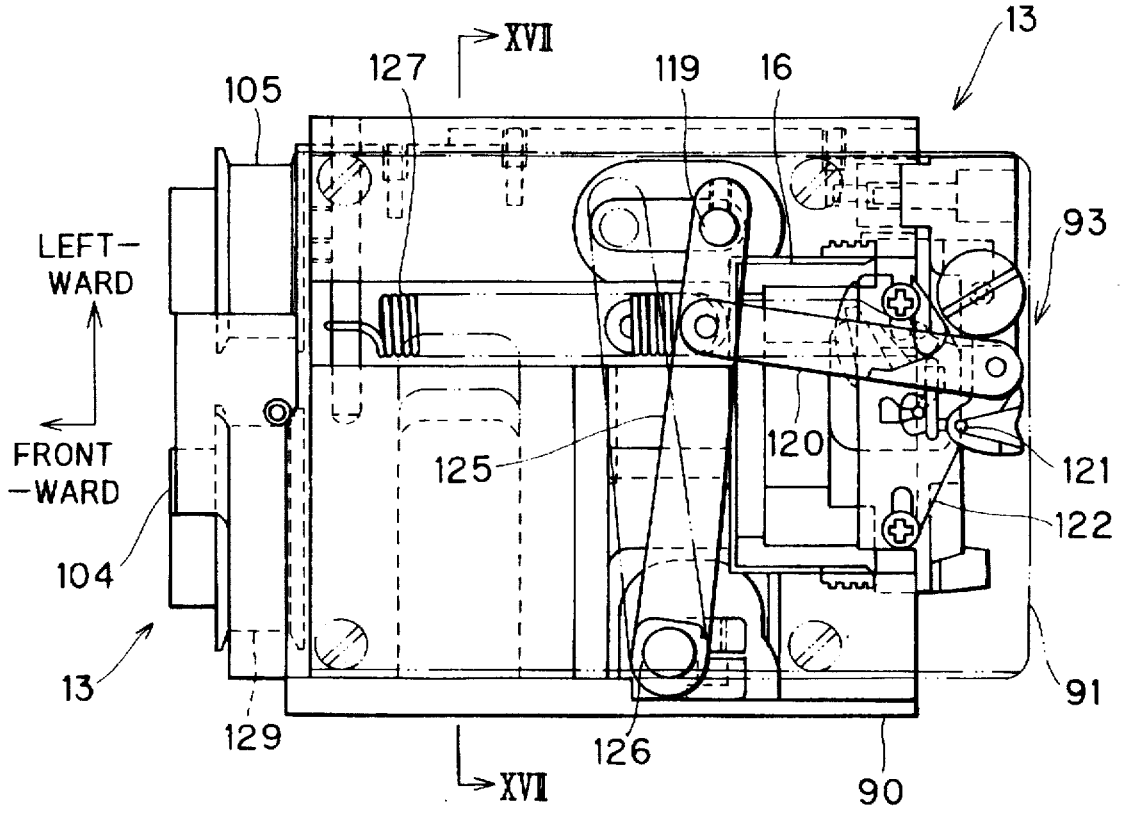
FIG. 11 is a plan view showing the shuttle module of the bed portion.

As shown in FIGS. 11 and 12, the thread cutting mechanism 93 includes: a mobile blade 121 of a mobile blade member 120 disposed below the needle plate 91; a fixed blade 123 fixed to the lower surface of the needle plate 91; and a thread guide plate 122 disposed beneath the blades 121, 123. The needle and bobbin threads 124 extending downward from the workpiece cloth through a guide hole 122*a* of the thread guide plate 122 and a needle hole of the needle plate 91 are cut by cooperative operation of the mobile blade 121, the fixed blade 123, and the thread guide plate 122. The front tip of the mobile blade member 120 is connected to a midway portion of a link plate 125. A right tip of the link plate 125 is freely rotatably connected to the housing 90 via a connection rod 126. The link plate 125 is swingable between a release position indicated by the solid line in FIG. 11 and an operation position indicated by a two-dot chain line in FIG. 11.

Figure 13:
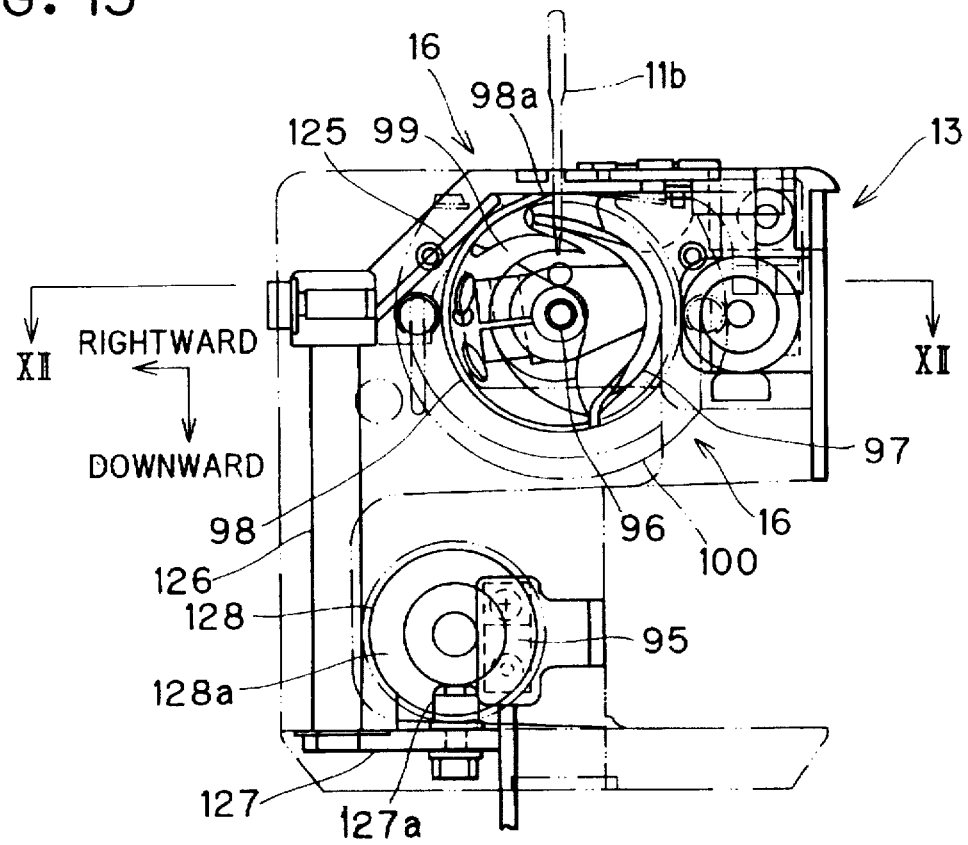
FIG. 13 is a rear view partially in phantom showing the shuttle module.

The link plate 125 is urged into the operation position by a pulling spring 127. From this condition, the link plate 125 is driven by drive force of the drive shaft 104 to cut the threads at a predetermined timing. The drive force of the drive shaft 104 is transmitted to the link plate 125 by the following configuration. As best seen in FIG. 13, the upper tip of the connection rod 126 is fixed to the right tip of the link plate 125. The lower tip of the connection rod 126 is fixed to the right tip of an arm member 127. A cam engagement ring 127*a* at the left tip of the arm member 127 is capable of abutting a cam surface 128*a* of a cam body 128 attached to the drive shaft 104.

The link plate 125 is switched from its release position to its operation position by an air cylinder 129 disposed in the cylinder housing indentation 102. As best shown in FIGS. 11 and 15, a rod 119 is connected to the left tip of the link plate 125 and depends downward. A nut member 129*b* at the tip of a rod 129*a* of the cylinder 129 presses against the rod 119 in order to maintain the link plate 125 in its release position. At a predetermined thread cut timing, the urging force of the air cylinder 129 is released, whereupon the link plate 125 is switched into its operation position by urging force of the pulling spring 127. Then, as shown in FIGS. 13 and 16, the cam engagement ring 127*a* abuts the cam surface 128*a* so that the link plate 125 operates according to the shape of the cam surface 128*a* via the connection rod 126, to cut the thread. Directly afterward, the air cylinder 129 is switched so that the link plate 125 returns to its released position. Although not shown in the drawings, a thread cutting valve of an air supply system for supplying air to the air cylinder 129 is controlled by the control unit 140. If for some reason, movement of the shuttle is stopped directly before a thread is to be cut, the link plate 125 is returned to its release position by the air cylinder 129 so that the thread cutting process is terminated. It should be noted that a solenoid can be used instead of the air cylinder 129.

Next, an explanation will be provided for the lubrication supply mechanism 130. As shown in FIG. 16, an oil tank 131 is provided in an indentation portion 117 formed in the housing 90 at the front side of the drive shaft 104. A wick 132 for supplying oil from the oil tank 131 to sliding portions between the sleeve body 114 and the shuttle shaft 96 extends from the oil tank 131 to a hole formed in the sleeve body 114.

The following is an explanation of operations of the two-needle sewing machine 1. The oscillating shuttle 16, the servomotor 21 for driving the oscillating shuttle 16 independently from the principal shaft 6, and the drive transmission system are formed into a unit in the shuttle module 13. Because the shuttle module 13 is detachably provided to the two-needle sewing machine 1, the drive system can be simplified and made more compact than if the oscillating shuttle 15 were driven by the principal shaft 6. The half rotation shuttle 15 which is nearest the column portion 3 of the two-needle sewing machine 1, is configured to be driven by drive force of the principal shaft 6. Therefore, the oscillating shuttle 15 can be driven by a drive system using a relatively simple configuration. Also, a servomotor need not be provided for the oscillating shuttle 15 so that the two-needle sewing machine 1 is less expensive to produce.

When the shuttle module 13 is switched from its usage position, which is at a 45 degree angle rotated horizontally from its retracted or inoperative position, the front portion of the oscillating shuttle 15 and the rear portion of the oscillating shuttle 16 are exposed so that the replacement of the bobbins in the oscillating shuttles 15, 16 and removal of tangle threads can be more efficiently performed.

Further, the minute movement mechanism 56 for moving the shuttle module 13 slightly frontward and rearward enables the position of the oscillating shuttle 15 to be automatically minutely adjusted frontward and rearward. As a result, adjustment of the distance between the two shuttles can be easily adjusted to match adjustments in the distance between the needles. Also, the positional relationship between the sewing needle 11*b* and the loop seizing beak 98*a* of the oscillating shuttle 15 can be adjusted by the minute movement mechanism 56. Because the shuttle module 13 is provided in an integral unit, assembly of the sewing machine and its operation can be performed more efficiently. When one of the mechanisms or components in the shuttle module 13 becomes defective or breaks down, the shuttle module 13 can be easily detached from the pivot frame 57 and repaired. Also, the shuttle module 13 can be used with a variety of different types of sewing machines so that design and production costs of each of the different types of sewing machines can be reduced.

Because the thread cutting mechanism 93 is in the shuttle module 13, the thread can be automatically cut by operating the air cylinder 129 by commands from the control unit 140. As a result, sewing operations can be more efficiently performed. Also, because the oil supply mechanism 130 has a simple configuration for supplying oil to the sliding portions of the shuttle shaft 91 within the shuttle module 13, there is no need to manually oil the sliding portions. Oil will never run out so that high reliability can be maintained.

Next, modifications of the embodiment will be described.

Figure 18:
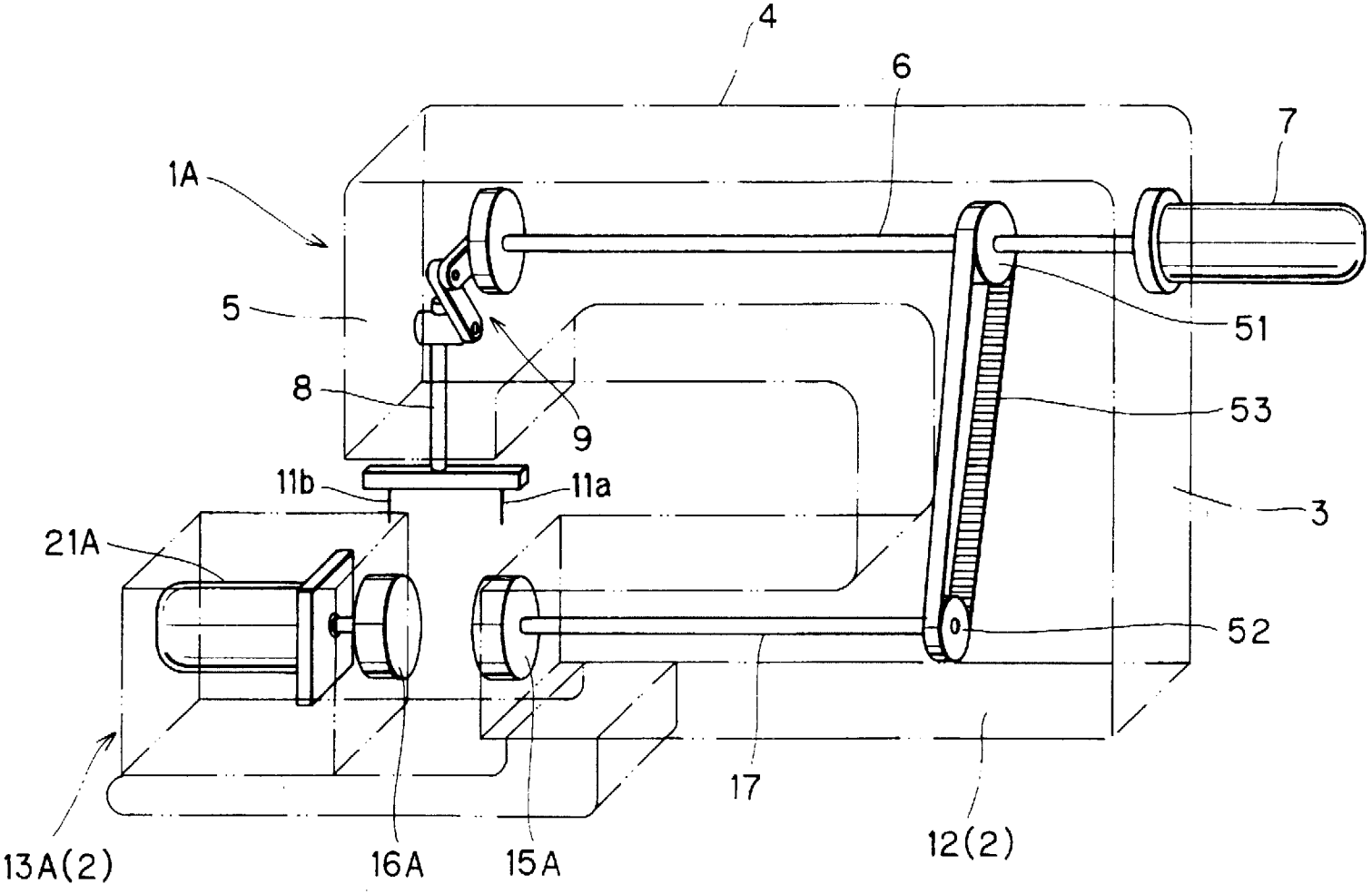
FIG. 18 is a perspective view partially in phantom schematically showing a two-needle sewing machine according to a modification of the embodiment.

FIG. 18 is a schematic view of a two-needle sewing machine 1A according to a modification of the embodiment. The two-needle sewing machine 1A includes a pair of rotary hooks 15A, 16A. In order to drive the rotary hook 16A using the drive force of the principal shaft 6, a pulley 51 attached to the principal shaft 6 and a pulley 52 attached to the tip of the shuttle shaft 17 are connected by an endless timing belt 53 spanning therebetween. With this configuration, the principal shaft 6 and the shuttle shaft 17 are rotated at the same speed. Although a shuttle module 13A is provided with substantially the same configuration as the shuttle module 13, the shuttle module 13A includes a rotary hook 16A; a servomotor 21A for driving the rotary hook 16A independently from the principal shaft 6; and a drive transmission system for transmitting drive force of the servomotor 21A to the full rotary hook 16A.

Other components of the configuration of the shuttle module 13A are substantially the same as those of the shuttle module 13. The two-needle sewing machine 1A differs from the two-needle sewing machine 1 only in that the rotary hooks 15A, 16A are used instead of the oscillating 15, 16. Therefore, the operations and the effects of the two-needle sewing machine 1A are substantially the same as those of the two-needle sewing machine 1.

Figure 19:
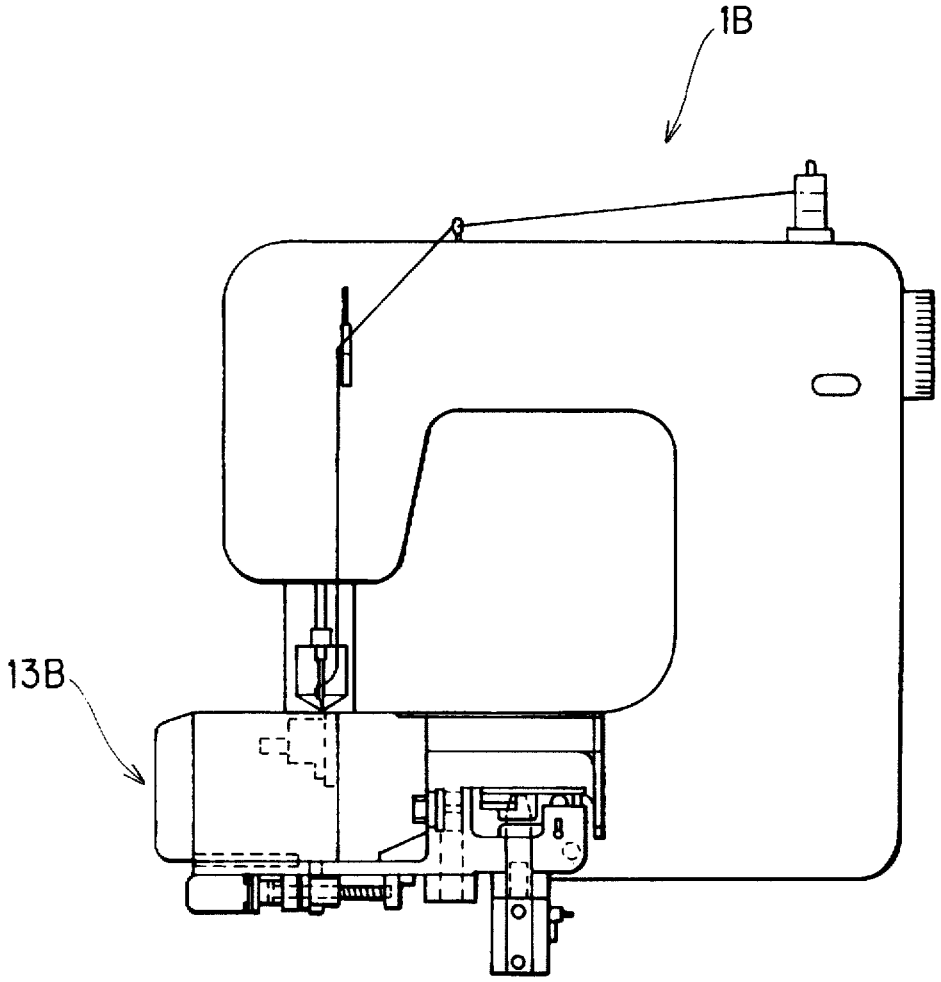
FIG. 19 is a side view showing a single-needle sewing machine according to another modification of the embodiment.

As shown in FIG. 19, a shuttle module 13B with the same configuration as the shuttle module 13 can be provided to a bed portion of a single needle sewing machine 1B. Similarly, a shuttle module having the same configuration as the shuttle module 13 can be provided to each bed portion of a multi-head sewing device. For example, the present invention could be applied to a sewing machine provided with two or more loop takers operated in synchronization with two or more needles. In this case, the thread loop taker nearest the column portion could be connected to move with the principal shaft and the other thread loop takers could be combined in a unit with their respective motors in a single shuttle module detachably fixed to the bed portion of the sewing machine. In each case, the loop taker can be either an oscillating shuttle or a rotary hook.

The shuttle module 13 is only an example. A variety of modifications can be made to its configuration and to the components used therein. For example, a pulse motor can be used instead of the servomotor 21. Also, the oscillating shuttle or the rotary hook can be driven directly by the pulse motor or the servomotor.

The positional switching mechanism 55 can be designed so that the retracted or inoperative position is pivoted more than 45 degrees to, for example, 90 degrees with respect to the usage position.

Although the position switching mechanism 55 is described as a pivotal type position switching mechanism, a sliding type position switching mechanism is also conceivable. In this case, the slide type switching mechanism could be designed to allow switching the position of the shuttle module 13 between the usage position and the inoperative position wherein the inoperative position is shifted about 10 cm in front of the usage position. When the sewing machine is in use, the shuttle module 13 can be fixed in place by a screw or a bolt. In this case, sufficient space can be secured to allow a user to insert his or her hand between the pair of oscillating shuttles 15, 16 by unscrewing the screw or the bolt and switching the shuttle module 13 to its inoperative position. This facilitates bobbin replacement and thread processes performed on the oscillating shuttles 15, 16. The switching action of the shuttle module 13 can be performed manually or via an air cylinder or a solenoid. The sliding type position switching mechanism can be applied to any of the sewing machines shown in the attached drawings. Additionally, a variety of modifications can be made to the thread cutting mechanism or to the oil supply mechanism.

Although the present invention is described in the embodiment as applied to a sewing machine using the shuttles 15, 16, the present invention could also be applied to any sewing machine using any type of loop taker, such as a looper type, a rotary hook type, or an oscillating shuttle type. An example of a looper type is described in U.S. Pat. No. 3,742,880, the disclosure of which is incorporated herein by reference. An example of a rotary hook type is described in U.S. Pat. No. 2,085,699, the disclosure of which is incorporated herein by reference. An example of an oscillating shuttle type is described in U.S. Pat. No. 3,006,298, the disclosure of which is incorporated herein by reference.

Operations can be further facilitated by employing an air cylinder or a solenoid to switch the position of the shuttle module 13.

The shuttle 15 is driven by the principal shaft 6 via a transmission system and the shuttle 16 is driven directly by the servo motor 21 independently from the principal shaft 6. The shuttle module 13 including the shuttle 16 and the servo motor 21 is a part of the bed portion 2, but detachably attached to the bed portion 2.

Because the shuttle 16 is driven independently from the principal shaft 6, no connection shaft needs to be provided extending from the principal shaft 6 to the shuttle 16. Therefore, the means for driving the shuttle 16 can be made more compact, with fewer parts, and in a simpler configuration. Also, the shuttle module 13 and the bed portion 2 can be made more compact.

Also, the rotational speed and the rotational position of the shuttle 16 can be constantly controlled by controlling the servo motor 21, as required by the particular workpiece cloth being sewed on, to drive the shuttle 16 in synchronization with the vertical movement of the needle 11*b*. Therefore, the shuttles 15, 16 can be driven with greater precision than if they were both driven by the principal shaft 6. Also, the distance between the shuttles 15, 16 can be adjusted in their axial direction when adjusting the distance between the pair of needles 11*a*, 11*b*. Also, when the shuttle 16 or the servo motor 21 needs repair or maintenance, these can be easily and efficiently performed by removing the shuttle module 13.

However, a transmission shaft including universal joints could be provided between the principal shaft 6 and the shuttle 15 for transmitting drive force from the principal shaft 6 to the shuttle 15.

Because the same shuttle module 13 can be used with a variety of different sewing machines, its general usability is high and its production costs are low. Because the shuttle 15 is driven by the principal shaft 6, a separate drive motor need not be provided for driving the shuttle 15, thereby further reducing production costs.

Because the shuttle 15 is disposed nearer the columnar portion 3, the transmission system for transmitting drive force from the principal shaft 6 to the shuttle 15 can be made with a simple configuration.

However, by disposing the shuttles 15, 16 in confrontation and very near each other, removing the needle plate, exchanging bobbins, untangling the bobbin thread, and other operations involving the shuttles 15, 16 can be difficult to perform. Therefore, adding a mechanism for switching the shuttle module 13 between the usage position and a retracted inoperative position by horizontally pivoting the shuttle module 13, allows operations involving the shuttle 15, 16 to be easily performed.

The shuttle module 13 can be switched from the usage position to the retracted position by unlocking the lock pin 62, and pressing the front tip of the shuttle module 13 frontward or rearward, whereupon the pivot frame 57 and the shuttle module 13 pivot around the support shaft 58 and into the retracted inoperative position. To return the shuttle module 13 to its usage position, the reverse procedure is followed.

What is claimed is:

1. A sewing machine comprising:

a needle bar for mounting two needles separated by a distance in a principal shaft direction;

a principal drive shaft for driving the needle bar, said principal drive shaft extending in a principal shaft direction;

a first motor for driving said principal drive shaft;

a bed portion;

a first loop taker disposed in the bed portion;

movement connection means for mechanically connecting movement between the first loop taker and the principal drive shaft;

a loop taker module coupled to the bed portion;

a second loop taker provided in the loop taker module;

drive means provided in the loop taker module and for driving the second loop taker independently of said principal drive shaft, said drive means comprising a second motor; and a position switching mechanism for switching the loop taker module between a usage position and a retracted, inoperative position by pivoting the loop taker module.

2. A sewing machine as claimed in claim 1, further comprising a columnar portion connected to the bed portion, wherein the first loop taker is disposed at a position of the bed portion a distance from the columnar portion and the second loop taker is disposed on the loop taker module at a position that is confronting the first loop taker and that is further from the columnar portion than the first loop taker.

3. A sewing machine as claimed in claim 2, further comprising a head portion housing the principal drive shaft, wherein the columnar portion connects the bed portion with the head portion.

4. A sewing machine as claimed in claim 2, further comprising a frame extending horizontally from a lower surface of the bed portion, wherein the loop taker module is detachably fixed at its lower surface to the frame.

5. A sewing machine as claimed in claim 1, wherein the position switching mechanism includes:

a pivot frame extending horizontally from a lower surface of the bed portion and to which a lower surface of the loop taker module is detachably fixed; and an upright shaft pivotally attaching the pivot frame horizontally pivotable with respect to the bed portion.

6. A sewing machine as claimed in claim 5, further comprising an axial position adjustment mechanism enabling minute adjustments in position of the loop taker module with respect to the principal shaft direction.

7. A sewing machine as claimed in claim 6, wherein the axial position adjustment mechanism includes:

a pulse motor fixed to one of the loop taker module and the bed portion;

a ball screw shaft rotatably driven by the pulse motor and rotatably supported by the bed portion; and a ball screw nut in screwing engagement with the ball screw shaft and connected with the loop taker module to move reciprocally therewith.

8. A sewing machine as claimed in claim 1, wherein the position switching mechanism further includes a low friction bearing member for facilitating pivoting movement of the loop taker module.

9. A sewing machine as claimed in claim 1, further comprising an axial position adjustment mechanism enabling minute adjustments in position of the loop taker module with respect to the principal shaft direction.

10. A sewing machine as claimed in claim 1, further comprising an axial position adjustment mechanism enabling minute adjustments in position of the loop taker module with respect to the principal shaft direction.

11. A sewing machine as claimed in claim 10, wherein the axial position adjustment mechanism includes:

a pulse motor fixed to one of the loop taker module and the bed portion;

a ball screw shaft rotatably driven by the pulse motor and rotatably supported by the bed portion;

a ball screw nut in screwing engagement with the ball screw shaft and connected with the loop taker module to move reciprocally therewith.

12. A sewing machine as claimed in claim 1, wherein the first and second loop takers are oscillating shuttles.

13. A sewing machine as claimed in claim 1, wherein the first and second loop takers are loopers.

14. A sewing machine as claimed in claim 1, wherein the first and second loop takers are rotary hooks.

15. A sewing machine comprising:

a needle bar for mounting two needles;

a principal drive shaft for driving the needle bar, said principal drive shaft extending in a principal shaft direction;

a first motor for driving the principal drive shaft;

a bed portion;

first and second loop takers disposed in the bed portion each at a position corresponding to one of the needles;

movement connection means for mechanically connecting movement between the first loop taker and the principal drive shaft;

a loop taker module coupled to the bed portion and including the second loop taker and a drive means for driving the second loop taker independently from the principal shaft, said drive means comprising a second motor; and position switching means coupled to the loop taker module for switching a position of the module between a usage position and a retracted, inoperative position by pivoting the loop taker module.

* * * * *